US005761024A

United States Patent [19]

Tsuchiya et al.

[11] Patent Number: 5,761,024

[45] Date of Patent: Jun. 2, 1998

[54] DISCHARGE TUBE

[75] Inventors: Hiromitsu Tsuchiya; Takashi Sato, both of Susono, Japan

[73] Assignee: Yazaki Corporation, Tokyo, Japan

[21] Appl. No.: 561,027

[22] Filed: Nov. 21, 1995

[30] Foreign Application Priority Data

Nov. 24, 1994 [JP] Japan ..... 6-289434

[51] Int. Cl.[6] ..... H01J 17/20

[52] U.S. Cl. ..... 361/253

[58] Field of Search ..... 361/253, 257, 361/120

[56] References Cited

U.S. PATENT DOCUMENTS 3,814,969 6/1974 Kamiya et al. ..... 313/486

4,143,301 3/1979 Strauss et al. ..... 315/73

4,539,511 9/1985 Denbigh et al. ..... 313/624

4,574,219 3/1986 Davenport et al. ..... 315/49

*Primary Examiner*—Fritz Fleming

*Attorney, Agent, or Firm*—Nikaido Marmelstein Murray & Oram LLP

[57] ABSTRACT

A discharge tube of the present invention is disclosed comprising an electrically insulated container which is further provided with a pair of electrodes at opposite sides thereof and with inert gas and mercury enclosed therein, wherein the enclosed quantity of the mercury is 0.01 to 1 mg per one cubic centimeter of the capacity of the container and the enclosing pressure of the inert gas is 8 to 15 kgf/cm$^2$.

2 Claims, 3 Drawing Sheets

DISCHARGE TUBE

BACKGROUND OF THE INVENTION

1. Field of the Invention

The present invention relates to a discharge tube for controlling an electric voltage, and more particularly to a discharge tube used as a series gap in an ignition device for an automotive engine or the like.

2. Description of the Prior Art

In an ignition device for an automotive engine or the like, normally a high voltage is applied to an ignition plug to generate a spark, and recently there has been proposed an ignition device with a series gap wherein a discharge gap is provided in series with an ignition plug for preventing an imperfect ignition and thereby controlling an ignition timing correctly. For this purpose, there has been known an electric discharge tube that comprises a cylindrical container made of an insulation tube and a pair of discharge electrodes provided at opposite ends of the container with an inert gas enclosed therein.

For precisely controlling an ignition timing of the ignition plug by using a series-gap discharge tube as constructed above, a relatively higher voltage such as 10 KV or more in comparison with a voltage applied to the ignition plug is required as the discharge inception voltage thereof. However, if a long gap is provided between the opposite electrodes of the discharge tube for this purpose, the discharge keeping voltage should be also made high, so that a loss of energy which is to be supplied to the ignition plug is made large, thereby to impair a reliability of ignition by the ignition plug, and thus a more effective high voltage supplying equipment is required.

Accordingly, for the purpose of lowering only the discharge keeping voltage in order to minimize a loss of energy, a gas-ionization accelerating layer made of an oxide of alkaline earth metal or the like is formed on the electrode discharge surface on many occasions. However, if a discharge tube as constructed above is used as a series gap in an ignition device for an automotive engine or the like, the accelerating layer is likely to be worn to gradually raise the discharge keeping voltage, whereby the problem of energy loss is not as improved as expected. In addition, since a high voltage is applied to the ignition device the whole time, not only the durability thereof is affected, but a discharge noise is also made substantially large.

SUMMARY OF THE INVENTION

In order to accomplish the above object, the inventors of the present invention have perceived that an imperfect ignition of the ignition plug is likely to occur only when the inner-cylinder temperature is still low in such a moment as on the engine starting time, and accordingly they pursued this problem. As a result of their investigation, they finally found out that a discharge tube with a minimized loss of energy can be obtained if the discharge inception voltage thereof is lowered when the driving state is changed to a stabilized state from an engine starting time during which a discharge inception voltage is still high.

In other words, the objective of the present invention is to provide a discharge tube used as a series gap that enables a minimization of energy loss, wherein the discharge inception voltage thereof is high only when the inner-cylinder temperature is still low at which an imperfect ignition of the ignition plug is generated, and this objective can be obtained by a discharge tube which is provided with a pair of electrodes at opposite sides thereof facing to each other within an electrically insulated container in which an inert gas and granular mercury are enclosed.

In a discharge tube according to the present invention, the inert gas to be enclosed therein is preferably argon, and the enclosing pressure thereof is preferably 8 to 15 Kgf/cm$^2$ for setting the discharge inception voltage to more than 10 KV, or preferably to 15 KV during the engine starting period. Further, the quantity of mercury to be enclosed therein is preferably 0.01 to 10 mg per one cubic centimeter of the container capacity, and is still preferable if it ranges between 0.01 to 1 mg. If the quantity to be enclosed is out of this range, the capacity of each discharge tube is not stabilized, and if it is over the above range, the discharge inception voltage will not be stabilized.

When the discharge tube of the present invention is used as a series gap in an ignition device for an automotive engine or the like and the engine is activated to start, the discharge inception voltage thereof is substantially high likely as the conventional one which has no mercury enclosed therein, and also a time required to start a charge inception voltage with respect to the ignition plug is also substantially short likely as that of the conventional one, and further, the discharge keeping voltage is substantially lower than the conventional discharge tube in which there is no gas-ionization accelerating layer provided around the opposite electrodes. When the engine is driven to a stabilized state and accordingly the cylinder thereof is gradually heated, the temperature of the discharge tube integrated in the ignition device is also raised, so that the discharge inception voltage is gradually lowered to finally set to a predetermined value.

Other features and advantages of the invention will be apparent from the following description taken in connection with the accompanying drawing.

DETAILED DESCRIPTION OF THE PREFERRED EMBODIMENTS

Figure 4:
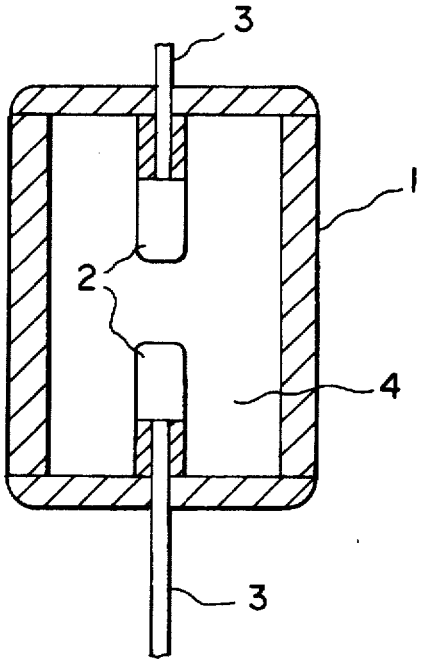
FIG. 4 illustrates a discharge tube of the present invention and its components.

An embodiment of the claimed invention is shown in FIG. 4. A container 1 is provided with a pair of electrodes 2 at opposite sides thereof in a facing relation to each other. A pair of pipes for wires 3 lead from the electrodes 2 to the outside of the container 1. Inert gas and mercury, represented by element 4, are enclosed in the container 1. A more detailed description of the preferred embodiment follows below.

In a ceramic container having an external diameter of 12 mm and an inner diameter of 9 mm, a 3-mm corrosion-resistant discharge electrodes having a high fusion point are disposed in a facing relation to each other, and after inserting granular mercury therein, argon gas is pressurizingly enclosed to be settled to a pressure level of 12 kgf/cm$^2$, so as to form a discharge tube having a container with 0.85 cm$^3$ of capacity.

Figure 1:
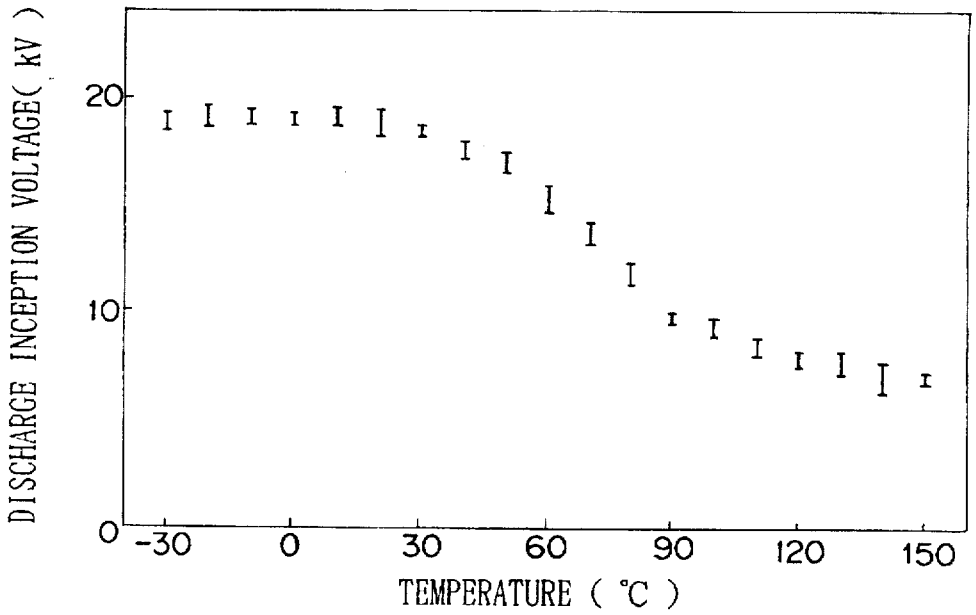
FIG. 1 is a characteristic view showing a relationship between a temperature and a discharge inception voltage of a discharge tube of the present invention.
Figure 3:
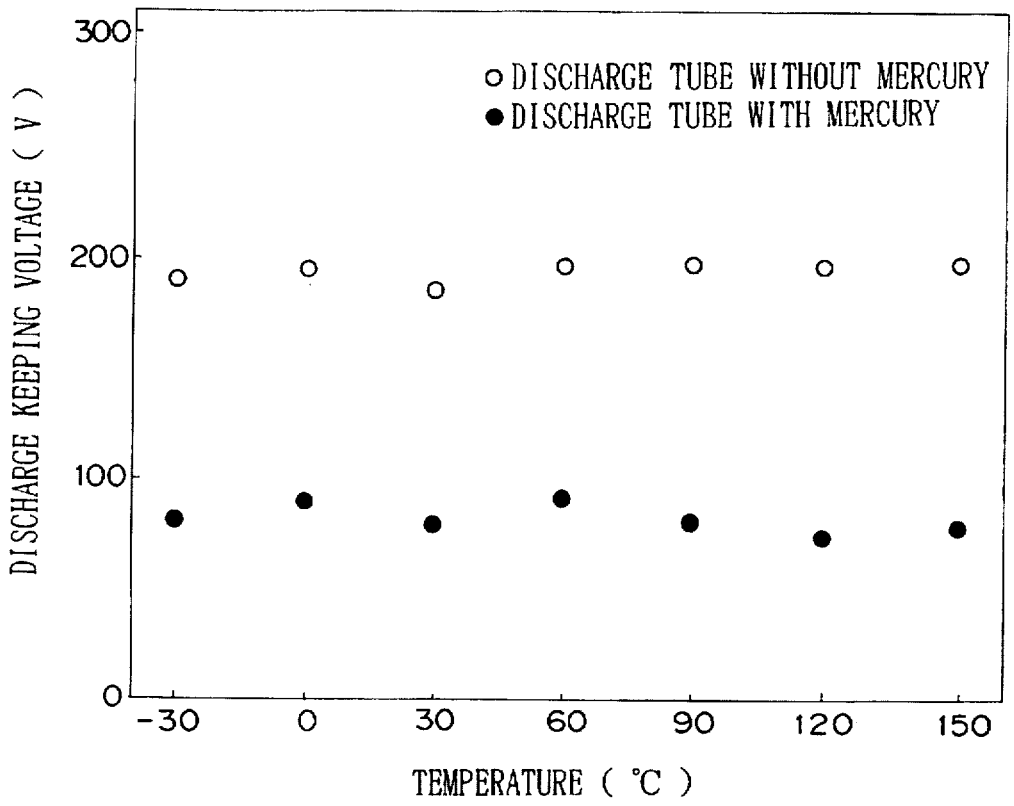
FIG. 3 is a characteristic view for comparing a conventional discharge tube and a discharge tube of the present invention from the view point of a relationship between a temperature and a discharge keeping voltage thereof.

The discharge tube as constructed above is put in a temperature-variable measuring chamber, and a high voltage pulse is applied thereto to measure the discharge inception voltage and the discharge keeping voltage thereof. Thereafter, by varying a temperature from −30° C. to 150° C., the relationship between a temperature and a discharge inception voltage was obtained as shown in FIG. 1. In other words, at a low temperature the discharge inception voltage was constantly around 19 Kv, but it is gradually lowered in accordance with a rise of the temperature, and at such a high temperature as 120° C., it is converged to approximately 7 to 8 Kv. On the other hand, the discharge keeping voltage was completely regardless of the variation of temperature and set in a substantially constant range of 90 to 100 V (FIG. 3).

Figure 2:
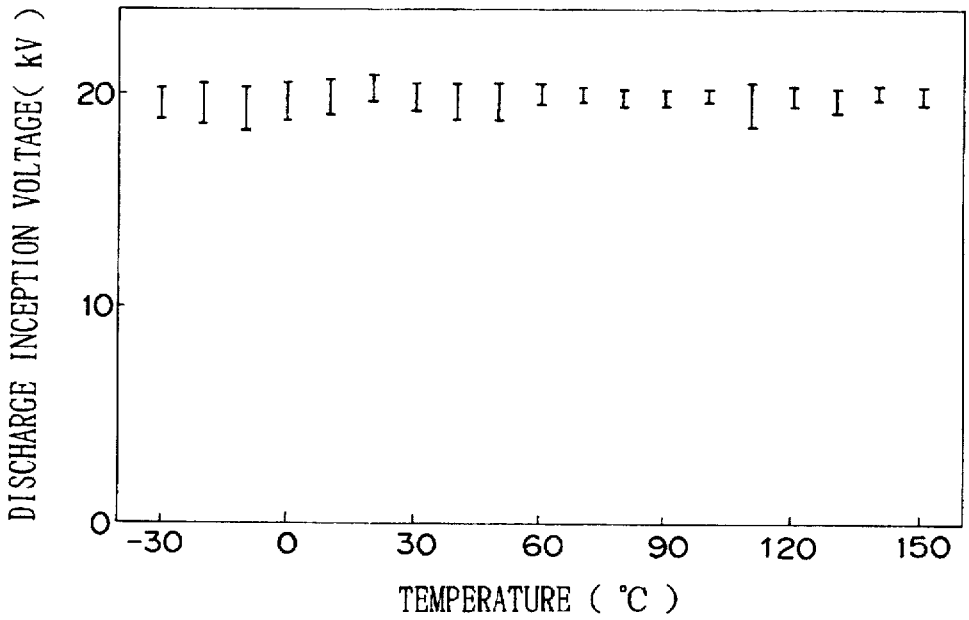
FIG. 2 is a characteristic view showing a relationship between a temperature and a discharge inception voltage of a discharge tube of a conventional device.

The same experiment as above except that the granular mercury was not enclosed therein was done to another discharge tube to detect the relationship between a temperature and a discharge inception voltage and that between a temperature and a discharge keeping voltage thereof samely, wherein the discharge inception voltage in a temperature range of −30° C. to 150° C. is constantly around 19 to 20 Kv, and the discharge keeping voltage is set in a substantially constant range of 190 to 200 V, so that a constant plain temperature characteristic was obtained. (FIGS. 2 and 3).

Further, the same experiment except that only 10 mg of granular mercury was enclosed therein was done to another discharge tube to detect the discharge inception voltage characteristic thereof, and accordingly it was found out that the discharge inception voltage at a low temperature is quite instable, and it varies every time when the detection is executed, so that there is no consistency in its characteristic.

[Effect of the Invention]

When a discharge tube according to the present invention is used as a series gap in an ignition device for an automotive engine, a high discharge inception voltage is detected at an engine starting time, so that a perfect ignition is performed, and even though it is lowered when the engine is driven to a stabilized state, an imperfect ignition is not likely to occur as the temperature of the cylinder of the engine is raised and thus there is no bad effect caused to the ignition function. Further, as the discharge keeping voltage is stable and low, an energy to be consumed for ignition of the engine can be greatly saved.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A discharge tube used for an ignition device in an engine and provided with an electrically insulated container, wherein said container is further provided with a pair of electrodes at opposite sides thereof in a facing relation to each other, and also having an inert gas and mercury enclosed therein, said mercury being present in a range of from 0.01 to 1 mg per one cubic centimeter of said container, the enclosing pressure of said inert gas being in a range of from 8 to 15 kgf/cm$^2$.

2. A discharge tube as claimed in claim 1, wherein said inert gas is argon gas.

* * * * *